US005715551A

United States Patent [19]

Proano et al.

[11] Patent Number: 5,715,551

[45] Date of Patent: Feb. 10, 1998

[54] CONVERTIBLE FURNITURE

[76] Inventors: Lou Proano; Rene D. Proano, both of 1648 Channelside Trail, Baldwinsville, N.Y. 13027-9052

[21] Appl. No.: 230,732

[22] Filed: Apr. 21, 1994

[51] Int. Cl.[6] ..... A47D 7/00

[52] U.S. Cl. ..... 5/93.2; 5/2.1

[58] Field of Search ..... 5/93.2, 2.1

[56] References Cited

U.S. PATENT DOCUMENTS

| | | | |
|---|---|---|---|
| 1,193,272 | 8/1916 | Laforest . | |
| 2,223,955 | 12/1940 | Greenbaum . | |
| 3,821,822 | 7/1974 | Borreggine . | |
| 4,361,919 | 12/1982 | Hull . | |
| 4,525,883 | 7/1985 | Necowitz . | |
| 4,982,464 | 1/1991 | Lucero | 5/93.2 |
| 5,038,427 | 8/1991 | Golden . | |
| 5,067,183 | 11/1991 | Urguiola | 5/2.1 |
| 5,077,846 | 1/1992 | Wheeler, III et al. . | |
| 5,146,631 | 9/1992 | Deal | 6/93.2 |
| 5,163,190 | 11/1992 | Hwang | 5/93.2 |
| 5,173,974 | 12/1992 | Proano et al. . | |
| 5,297,305 | 3/1994 | Williams | 5/93.2 |

FOREIGN PATENT DOCUMENTS

| | | | |
|---|---|---|---|
| 1270106 | 6/1990 | Canada | 5/93.2 |
| 2601572 | 1/1988 | France | 5/93.2 |

*Primary Examiner*—Michael J. Milano

*Attorney, Agent, or Firm*—August E. Roehrig, Jr.

[57] ABSTRACT

An article of furniture which may be configured in the form of a crib, a youth bed, or an adult bed, wherein a crib structure is produced through the employment of a rear panel, a right side panel, a left side panel, a front panel and a first mattress support frame. The front panel comprises of a stabilizer bar and a gate. The gate is movable to permit greater access to the confines of the crib. The gate may be in the form of a "swing" gate or a "drop" gate. The crib is convertible to a youth bed by rearranging and/or eliminating components forming the gate and stabilizer bar. The gate or stabilizer bar may be arranged to form a roll bar to prevent a slumbering toddler from rolling off of the edge of the mattress, and when pivotally inverted, eliminate the roll bar and function to provide increased stability. The stabilizer bar may be removed and reattached to the youth bed at alternative locations, where the same is substantially concealed while providing increased stability for the youth bed configuration. The youth bed is convertible to an adult bed through a further rearrangement and/or elimination of structural elements. Particularly, the right and left side panels are replaced by right and left bed rails and the mattress support frame is eliminated. The rear panel defines a headboard and the front panel, or a portion thereof, defines a footboard. The transition from one configuration to another is simple.

27 Claims, 9 Drawing Sheets

CONVERTIBLE FURNITURE

BACKGROUND OF THE INVENTION

1. Field of the Invention

The present invention relates to an article of furniture which may be converted into the form of a crib, a youth bed, or an adult bed.

2. Description of the Prior Art

This invention provides improved convertible furniture including a drop front crib, wherein the movable drop front, inverted or not inverted, becomes the footboard of an adult bed, there also being a youth bed configuration of this form of the invention. Also, a stabilizer bar is provided, which becomes a roll bar or rail in the youth bed configuration and an alternative foot board in the adult bed configuration. The invention also includes an improved swing gate crib, convertible to a youth bed and an adult bed.

As infants grow to be toddlers and continue to develop from children into adults, bedding requirements change. Typically, cribs are suitable for infants. Cribs generally are structured such that the mattress is elevated so as to not require the parent or the infant's attendant to bend over a substantial amount to cradle and lift the infant when removing the infant from the crib. More often than not, cribs are provided with a boundary disposed about the entire periphery of the mattress for the purpose of protecting and preventing the infant from rolling off of the mattress onto the floor. To further assist in the handling of the infant or the removal of the infant from a cradle, a portion of the railing is usually mobile. That is, a gate may be provided or a segment of the railing may be movable to offer greater access to the infant and the confines of the crib.

As the infant becomes a toddler, he or she eventually requires substantially more space. The crib is commonly replaced with a suitable bed and, more generally, with a youth bed configured specifically for the needs of a toddler. For example, unlike an infant, a toddler may be able to bed himself or herself. Although this may be true of toddlers, they may still require a security barrier to protect them from rolling off of the edge of the youth bed during sleep. Few youth bed configurations provide this security barrier feature. As the toddler matures on through his or her childhood, there will come a time when the he or she will no longer have need of a security barrier.

Ultimately, the child reaches adulthood and a greater amount of bedding space is desired. Again, as was the case with the crib, the youth bed will need to be replaced. The replacement of a bed is usually compounded with the replacement of an entire ensemble. This could prove to be a very expensive venture over a course of time. A single article of furniture which is configurable to form a crib, a youth bed, or an adult bed would virtually eliminate a scheduled replacement of furniture and, in effect, eliminate a periodic replacement of entire groups of furniture. U.S. Pat. No. 5,173,974, issued Dec. 29, 1992 to applicants, discloses such a convertible article of furniture.

There are other convertible articles of furniture which employ this general concept. However, none can be configured to form either a crib, a youth bed, or an adult bed simply by rearranging existing elements, that is to say, without augmenting additional elements. Examples of other convertible articles of furniture are shown in the following patents.

U.S. Pat. No. 1,193,272 issued Aug. 1, 1916 to Edward F. Laforest describes a combined bed and crib. The device described can be adjusted to different lengths, providing a crib for an infant and a bed which is adjustable to the size of a child as the child grows.

U.S. Pat. No. 2,223,955 issued Jun. 23, 1929 to Bernard Greenbaum discloses a bed which may be converted from a crib to a regular bed or a day bed. The conversion from one configuration to another is accomplished through the rearrangement or elimination of parts.

U.S. Pat. No. 3,821,822 issued Jul. 2, 1974 to Joseph L. Borreggine describes a combination cradle, crib, and youth bed.

U.S. Pat. No. 4,361,919 issued Dec. 7, 1982 to James R. Hull discloses a convertible child's bed which may be converted from a crib to a standard twin bed through the removal and rearrangement of parts.

U.S. Pat. No. 4,525,883 issued Jul. 2, 1985 to Loretta A. Necowitz teaches of a full size bed convertible to a crib. The full size bed is adaptable to receive railing about its periphery. With the railing disposed about the periphery of the bed, a crib is produced.

U.S. Pat. No. 5,038,427 issued Aug. 13, 1991 to Robert J. Golden discloses a crib which is convertible to a youth bed. The crib has removable sides and a vertically adjustable mattress support structure which permits the crib to be altered through various stages of the child's growth.

U.S. Pat. No. 5,077,846 issued Jan. 7, 1992 to Charles E. Wheeler, III et al. describes a variety of crib structures, one of which includes a bi-folding gate assembly. Any of the variety of cribs may be converted to form a variety of youth sized beds or adult sized beds. The conversion is accomplished through a particular arrangement of parts and through the rearrangement of parts.

A convertible article of furniture having structural elements that may be relocated to alternative locations that are not externally visible while simultaneously increasing the structural integrity of the article of furniture, would conserve storage space and make optimal use of component parts. Moreover, structural elements that may be altered to subsequently function in different capacities would further make optimal use of the structural elements.

None of the above inventions and patents, taken either singly or in combination, is seen to describe the instant invention as claimed.

SUMMARY OF THE INVENTION

The present invention relates to an article of furniture which may be configured in the form of a crib, a youth bed, or an adult bed. The crib structure is produced through the employment of a rear panel, a right side panel, a left side panel, a front panel and a first mattress support frame. The four panels are interconnected to provide a substantially rectangular configuration. The front panel may be comprised of two independent sections, a lower section, or "stabilizer bar," and an upper section or gate. Alternatively, the stabilizer bar may be stored away and used later in the youth bed configuration, or the bar may be mounted beneath the crib mattress or below the crib rear panel so as to stabilize and strengthen the crib structure.

The mattress support frame is horizontally disposed within the rectangular crib configuration. This interconnection of parts yields a crib which has an upwardly extending barrier about the entire periphery of the mattress support frame and a mattress resting thereon. The mattress support frame is vertically adjustable to ensure that a peripheral barrier of a substantial height is provided to meet crib safety standards. The gate is movable to permit greater access to the confines of the crib and its occupant. The gate may be in the form of a "swing" gate or a movable "drop" gate. It is preferable that the movable drop gate be permitted to lower so as to allow easy access to the crib interior.

A unique additional feature of the movable drop gate is its later optional use as a footboard in the adult bed configuration, with the simple addition of a pair of side support legs or use of the crib front support legs; the drop gate may be inverted or not inverted when used as an adult bed footboard.

To convert the crib to a youth bed, the gate and the front panel are eliminated, the stabilizer bar (if in place on the front of the crib) is inverted, if desired, and the mattress support frame is vertically adjusted downwardly. If the stabilizer bar was not used in the crib configuration, it may be retrieved from storage and used as a part of the youth bed. The stabilizer bar, when inverted, functions as an optional "roll bar" or a security barrier purposed to prevent a slumbering toddler from rolling off of the edge of the mattress. The roll bar function may be eliminated from the youth bed by once again inverting the stabilizer bar. Now, the stabilizer bar may be attached to the crib or youth bed configuration at three alternative locations: to the rear panel; under a forward portion of the mattress support frame; or under an intermediate portion of the mattress support. In these locations, the stabilizer bar provides increased stability for both the crib and the youth bed configurations. Moreover, in each of these locations, aesthetics are enhanced because the stabilizer bar is substantially concealed from the exterior of the crib or youth bed.

In the swing gate configuration, the swing gate can be used as a roll bar in the youth bed, and later swing downward to simply function as a youth bed rail. Alternatively, it may be used with the stabilizer bar and function as a roll bar, and then later removed, leaving simply the stabilizer bar to function as a youth bed side rail.

The youth bed is convertible to an adult bed by removing the mattress support frame and the right and left side panels. The mattress support frame and the right and left side panels may be replaced by right and left bed rails. The right and left bed rails join the rear panel to the front panel. The rear panel defines a headboard and the front panel, or a portion thereof, defines a footboard. The transition from one configuration to another is simple. Alternatively, the gate may be used, in whole or in part, independently, or in combination with the stabilizer bar, as a footboard. Headboard extensions may be employed to enhance the aesthetic appearance of the adult bed. Thus, the user has a wide choice of footboards, these being the movable drop gate with two support legs, the stabilizer bar and the two short legs, or in the swing gate crib model, the stabilizer bar alone or combined with the swing gate, and two side support legs, or the swing gate alone. As a further alternative in either the movable drop gate or swing gate model, a separate footboard of any style can be separately provided.

During the various stages of transition, unused parts may be easily stored, taking up a relatively small amount of space. An entire bedroom group could be so designed that it may be employed an individual's entire lifetime and, if fabricated of quality materials, it could last for generations.

Accordingly, it is a principal object of the present invention to provide an article of furniture which may take on a plurality of individual configurations through the mere rearrangement, elimination, or addition of parts.

It is another object of the present invention to provide an article of furniture which may belong to a group or a set and which does not require periodic replacement and, hence, eliminates the periodic replacement of the group or the set.

It is another object of the present invention to provide an article of furniture which may employ a rear panel and a front panel which are, in whole or in part, common to each configuration.

It is a further object of the present invention to a front panel which, in whole or in part, may facilitate to provide an access gate for a crib, a "roll bar" or a stabilizer bar for a youth bed, a side rail for a youth bed, or a footboard for an adult bed.

It is yet another object that the access gate be a drop gate, or alternatively, a swing gate, which is movable to permit greater access to the confines of the crib and its occupant.

It is an object of the invention to provide a removable swing gate which can be repositioned as a roll bar or side rail in the youth bed configuration, either alone or in combination with a stabilizer bar.

It is an object of the invention to provide a removable swing gate which can be repositioned as a roll bar or side rail in the youth bed configuration, either alone or in combination with a stabilizer bar It is another object that the stabilizer bar be removable and reattachable to the youth bed at alternative locations to provide increased stability for the youth bed configuration and so as to be substantially concealed from the exterior of the youth bed.

Still another object of the present invention is to provide a decorative headboard extension which is releasably attachable to the rear panel to enhance the aesthetic appearance of the changing article of furniture throughout its useful life.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is an article of furniture which may be configured to provide a crib 110, a youth bed 140, or an adult bed 150. The article of furniture is similar to that shown and described in U.S. Pat. No. 5,173,974, issued to applicants on Dec. 29, 1992, and incorporated herein by reference.

Figure 1:
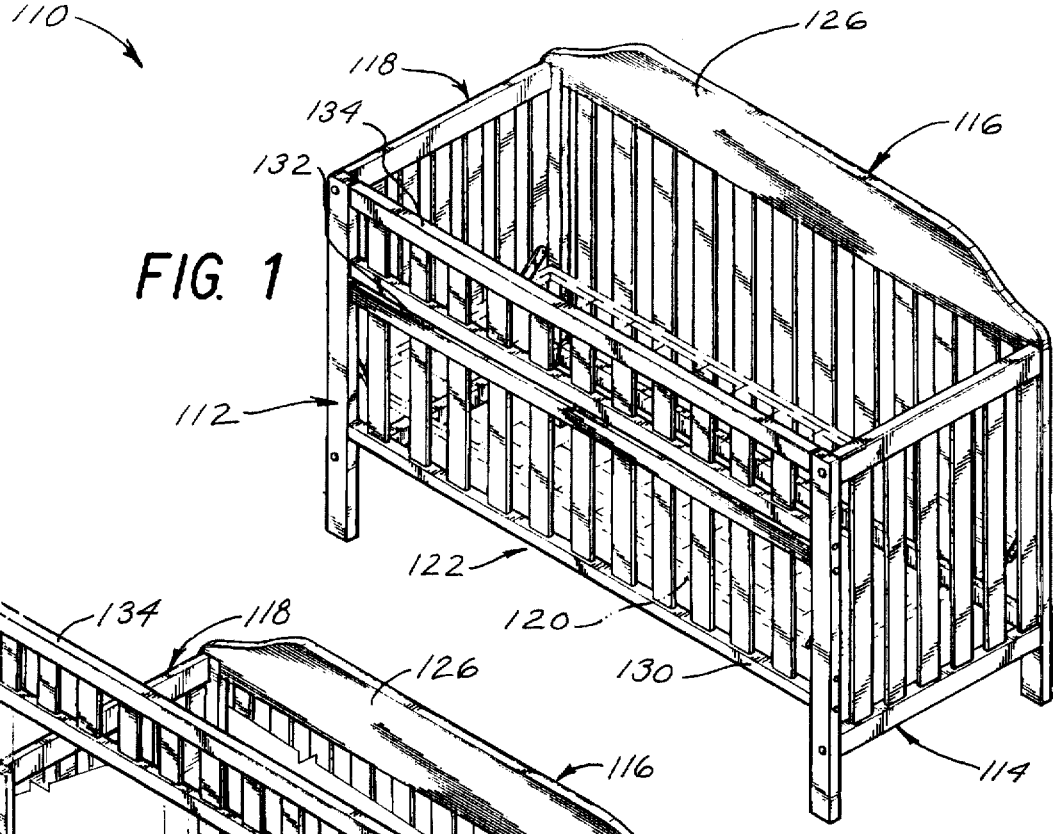
FIG. 1 is a front perspective view of a crib configuration according to the present invention with the stabilizer bar omitted.

A crib configuration 110 is shown in FIG. 1 comprising five basic elements, a front panel 112, a left side panel 114, a rear panel 116, a right side panel 118, and a mattress support frame 120. The front panel 112 is shown to include a gate 122 and a stabilizer bar 124. A supplemental panel 126 is shown attached coextensively to a top edge of the rear panel 116 in a coplanar relation.

The front panel 112 and the rear panel 116 are structured and dimensioned to define the front and rear sides of the crib 110 and are disposed in a spaced, substantially parallel relationship. The left side panel 114 and the right side panel 118 are structured and dimensioned to define the left and right sides of the crib configuration 110 and are disposed in a spaced, substantially parallel relationship, just as is the case with the front panel 112 and the rear panel 116. The interconnection of these four panels 112, 114, 116, 118 produces a substantially rectangular structure. The mattress support frame 120 is horizontally disposed within the rectangular frame structure.

Figure 2:
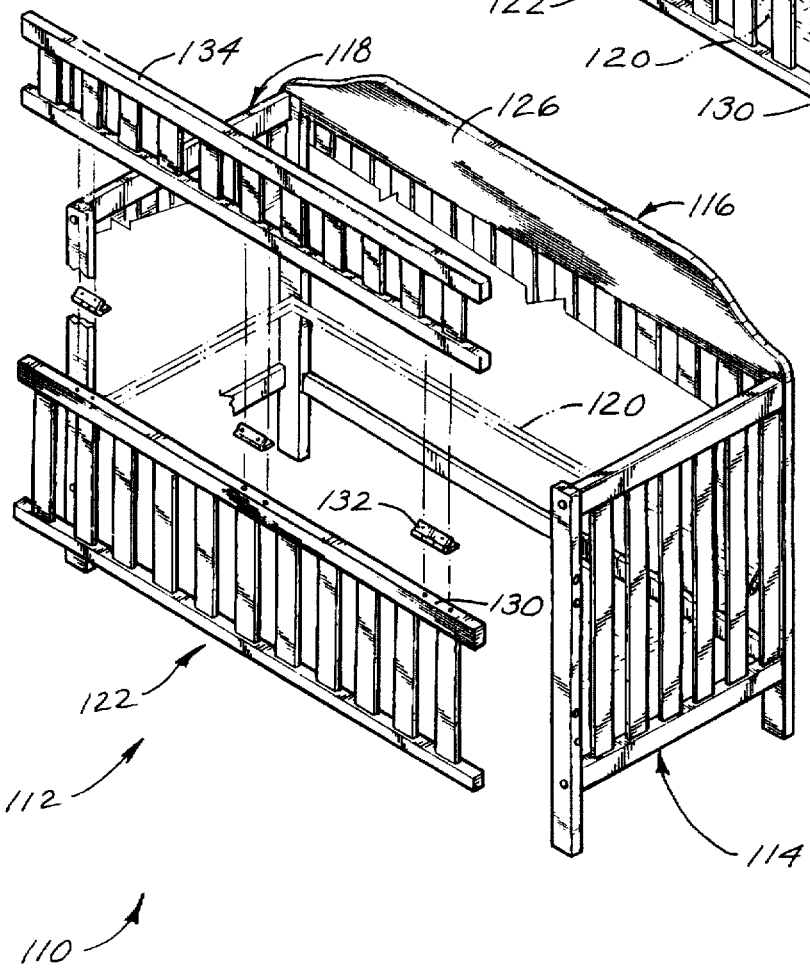
FIG. 2 is a diagrammatic representation of a front perspective view of the crib configuration shown in FIG. 1 with the front panel detached so as to form a youth bed, the front panel is shown in an exploded front perspective view.

As shown in FIG. 2, the front panel 112 is removed from the rest of the crib structure 110 so as to produce a youth bed configuration 140. In this view, it can easily be seen that the front panel 112 is formed by the gate 122 and the stabilizer bar 124, all arranged coextensively in a coplanar relation. Since the gate 122 and the stabilizer bar 124 are essentially planar and since the gate 122 and the stabilizer bar 124 have a substantially vertical attitude, the front panel 112 is essentially planar and substantially vertical. The gate 122 and the stabilizer bar 124 also include a top edge, bottom edge, a left edge, and a right edge.

The rear panel 116, which was a side of the crib configuration, also forms the rear side of the youth bed configuration 140. This rear panel 116 is essentially planar and substantially vertical. The rear panel 116 has a top edge, a right upright member, and a left upright member. The left side panel 114 is essentially planar and substantially vertical. This left side panel 114 includes a top edge, a bottom edge, a rear upright member, and a front upright member. The right side panel 118 is essentially planar and substantially vertical as well. This right side panel 118 also includes a top edge, a bottom edge, a rear upright member, and a front upright member.

The front panel 112 is extendable between the left side panel 114 and the right side panel 118 such that the left edge of the front panel 112 is removably attachable to the front upright member of the left side panel 114 and the right edge of the front panel 116 is removably attachable to the front upright member of the right side panel 118.

The rear panel 116 is extendable from the left side panel 114 to the right side panel 118 such that the left upright member of the rear panel 116 is removably attachable to the rear upright member of left side panel 114 and the right upright member of the rear panel 116 is removably attachable to the rear upright member of the right side panel 118. The mattress support frame 120 is horizontally disposed between the left side panel 116 and the right side panel 118 and is releasably attachable to the left side panel 114 and the right side panel 118.

The right edge of the front panel 112, or some portion thereof, is removably attachable adjacent to a left edge of the front upright member of the right side panel 118. The left edge of the front panel 112, or some portion thereof, is removably attachable to the right edge of the front upright member of the left side panel 114 in a similar fashion. The mattress support frame 120 is preferably vertically adjustable to selective heights. The mattress support frame 120 may be releasably attachable by any suitable means.

The gate 122 includes a substantially planar lower member 130 pivotally attached by a hinge element 132 to a substantially planar upper member 134, thus defining a bi-fold gate assembly. The lower member 130 is held stationary between the left side panel 114 and the right side panel 118. The upper member 134 is permitted to pivot on the lower member 130, sweeping forward radially 180 degrees about the axis of the hinge element 132, thus providing an open gate position. The gate 122 may be closed and held in a closed position by any suitable latching mechanism.

Figure 3:
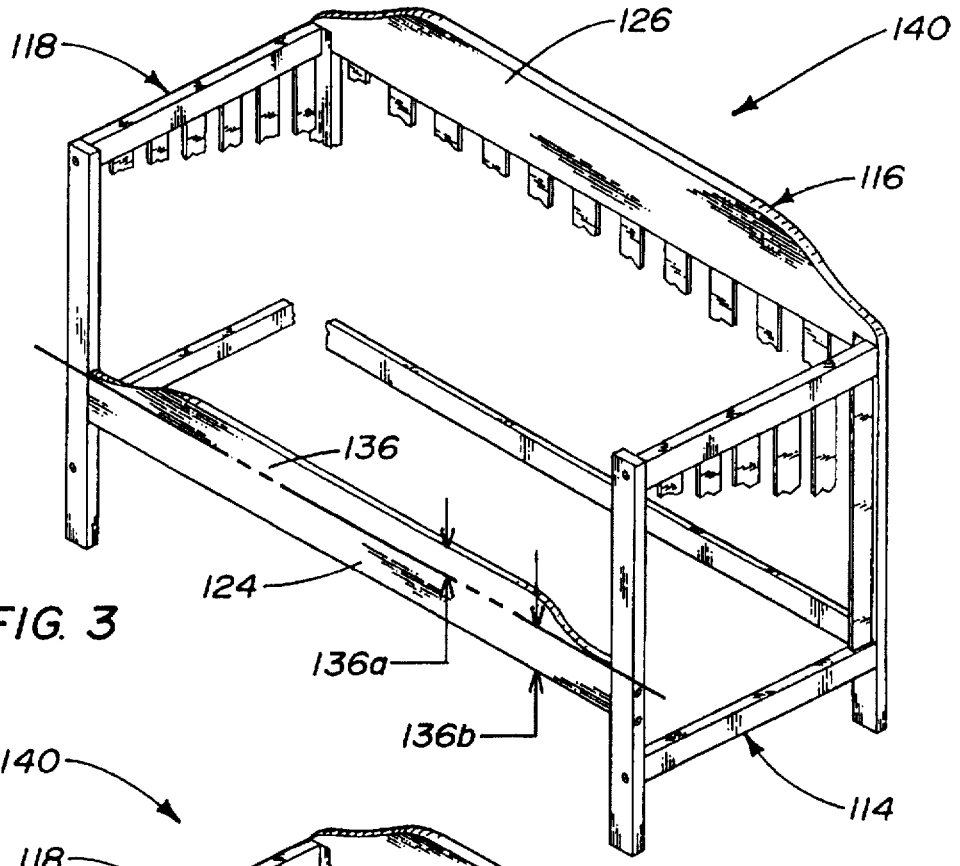
FIG. 3 is a diagrammatic front perspective view of a youth bed configuration according to the present invention showing the stabilizer bar attached thereto so as to form a security barrier or roll bar.

FIG. 3 shows the crib 110 of FIG. 1 converted to a youth bed 140. The conversion from the crib 110 to this youth bed 140 is accomplished simply by removing the gate 122 and the stabilizer bar 124, and relocating and reattaching the stabilizer bar 124. The stabilizer bar 124 has a vertically projecting longitudinal member 136 centrally disposed between the left and right side panels 114, 118. The width 136*a* of the vertically projecting portion 136 extends outwardly a distance at least substantially equal to the width 136*b* of the non-vertically projecting portion of the stabilizer bar 124. The longitudinal member 136 defines a "roll bar" or a security barrier to prevent a toddler from accidentally rolling off of the edge of the mattress. Note that the ease with which the crib 110 is converted to the youth bed 140 is made possible merely by the removal of threaded studs, for example; other fasteners common in the art may be employed. Yet, the remaining portion of the crib 110, that is youth bed 140, is still of a strong, solid construction, due to the stabilizing bar 124.

Figure 4:
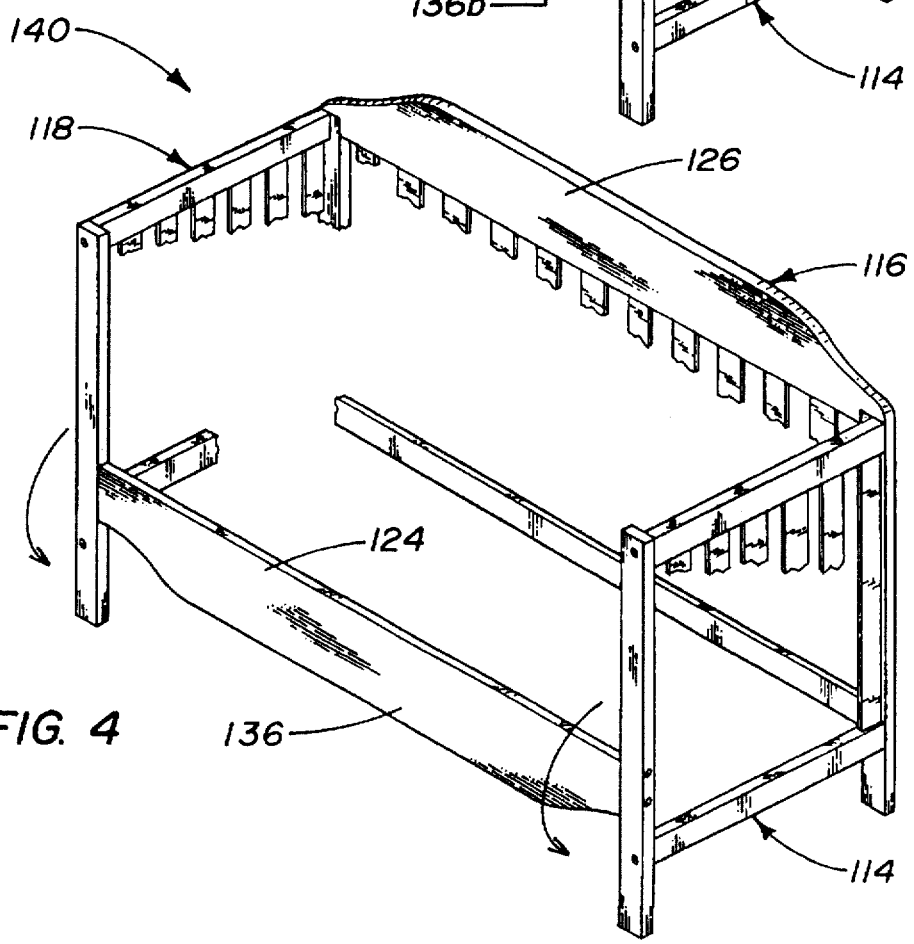
FIG. 4 is a diagrammatic front perspective view of a youth bed configuration according to the present invention showing the stabilizer bar pivotally inverted and reattached so as to provide a bed rail and increased stability.

FIG. 4 shows the youth bed 140 wherein the longitudinal member 136 is not employed as a roll bar. The conversion of the youth bed 140 is also very simple. The stabilizer bar 124 of the front panel 112 is detached by removing threaded studs (or whatever fasteners which may have been used) which hold the stabilizer bar 124 intact. With these studs removed, the stabilizer bar 124 may be inverted in precisely the same location. The stabilizer bar 124 is then reattached in this inverted position with the same threaded studs or fasteners used to secure the stabilizer bar in its initial configuration.

Figure 5:
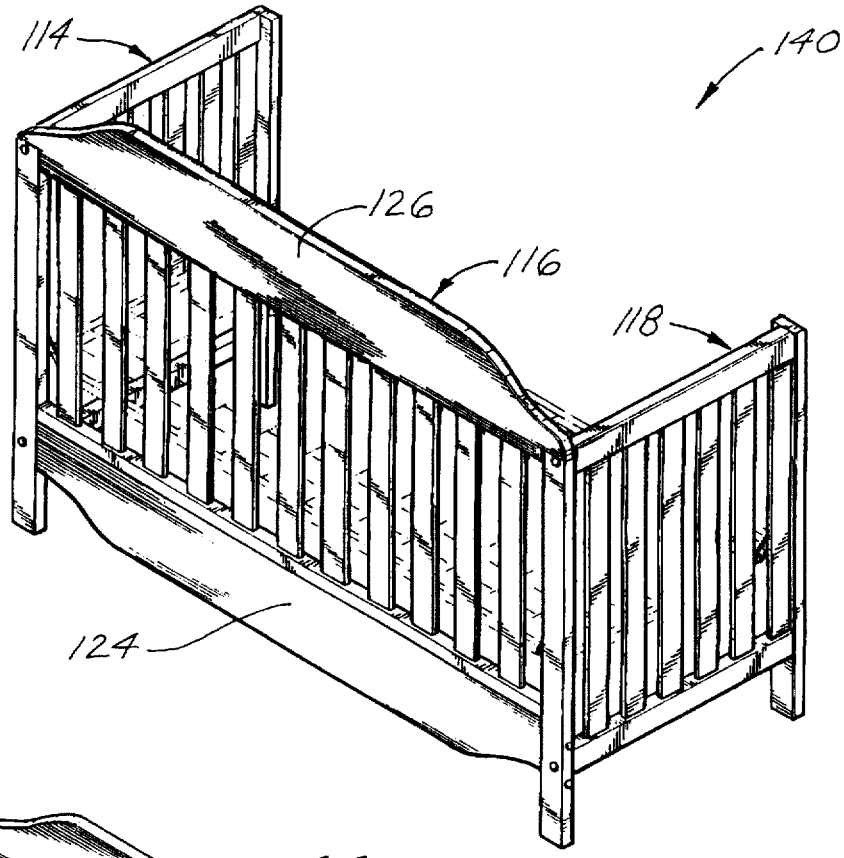
FIG. 5 is a diagrammatic rear perspective of the crib or youth bed configuration showing the stabilizer bar attached coextensively to the rear panel thereof so as to provide increased stability.
Figure 6:
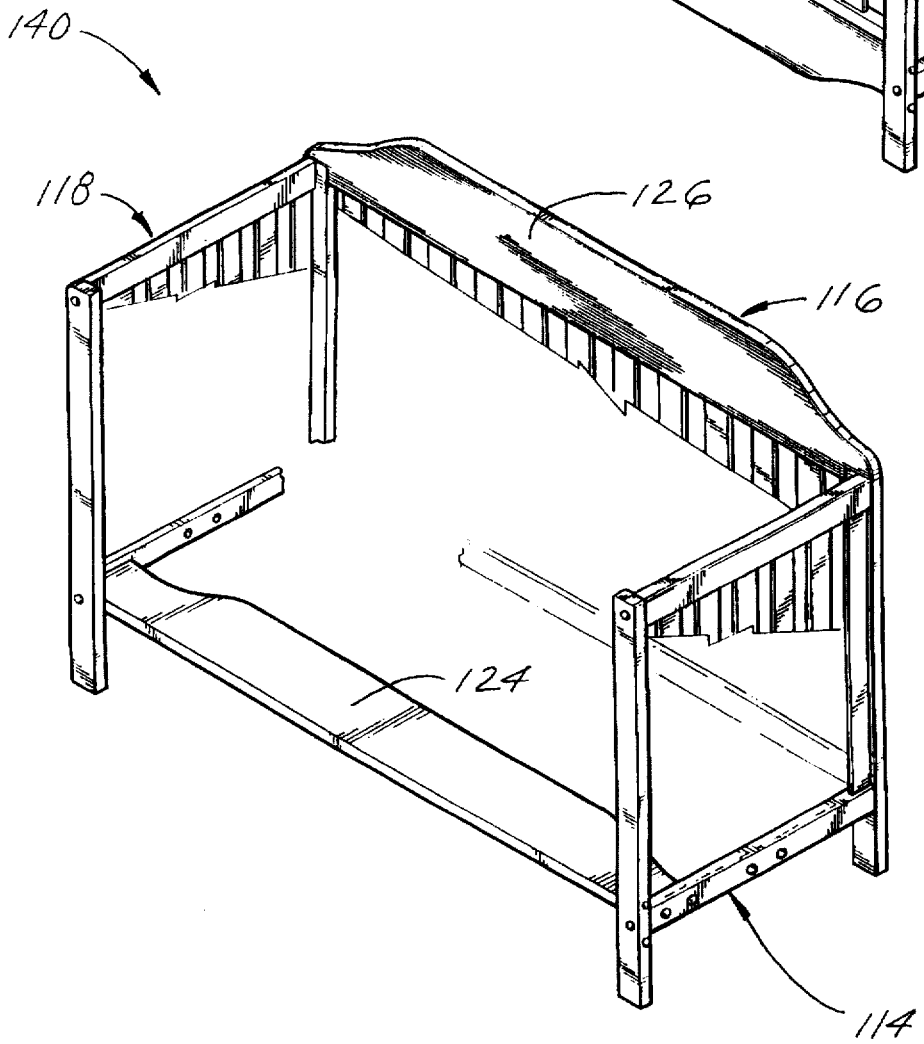
FIG. 6 is a diagrammatic front perspective of the crib or youth bed configuration showing the stabilizer bar attached thereto under a front portion of the mattress support frame so as to provide increased stability.
Figure 7:
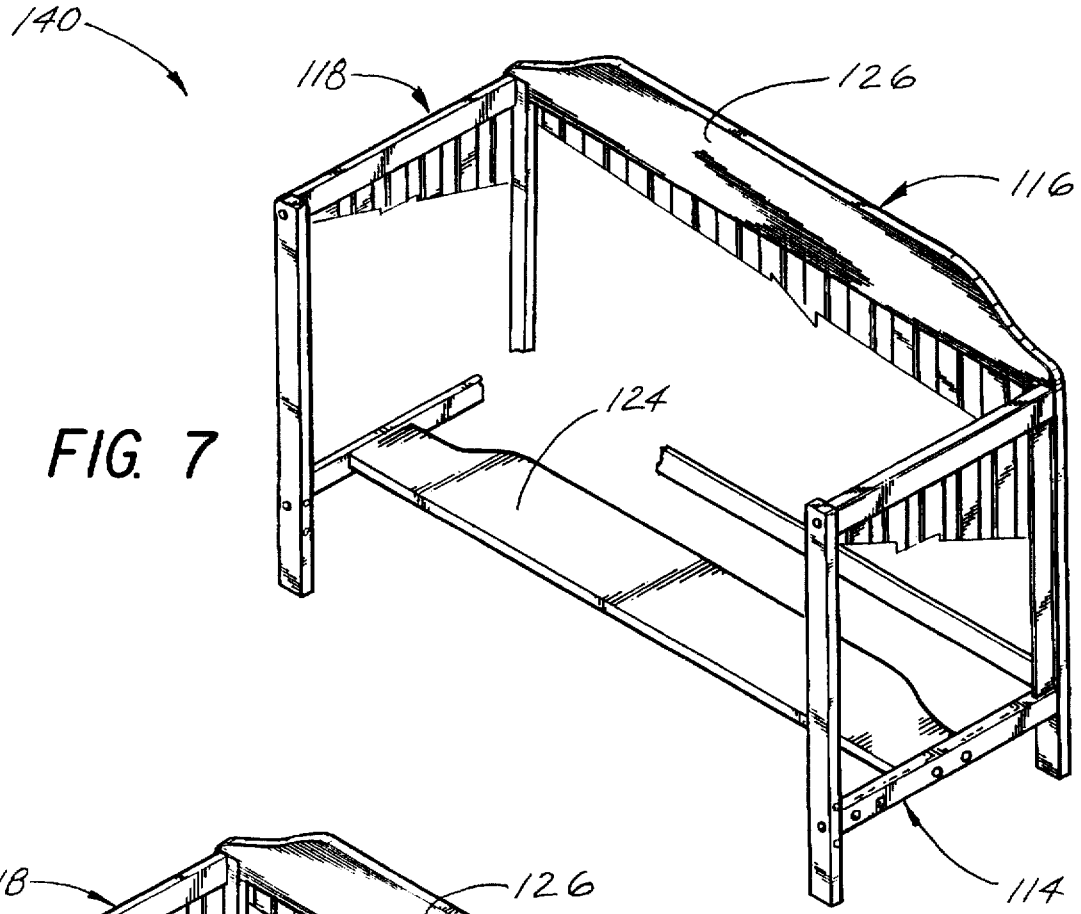
FIG. 7 is a diagrammatic front perspective of the crib or youth bed configuration showing the stabilizer bar attached thereto under an intermediate portion of the mattress support frame so as to provide increased stability.

FIGS. 5, 6, and 7 show the stabilizer bar 124 removed entirely from the front of the youth bed 140 and relocated or repositioned elsewhere. It should be recognized here that the constructions with alternative stabilizer locations shown in these three views apply equally to the crib configuration 110. Additionally, of course, the stabilizer locations specifically shown in the drawings and described infra are illustrative; other locations could be suitable. Also, it is intended that, in the crib configuration 110, it might be desirable to dispense with the stabilizer bar 124 altogether and simply store it away. This construction, with no stabilizer bar 124 in place, is illustrated in FIG. 1 (swing gate crib model) and in FIG. 13 (movable drop gate crib model). Later, when the crib is to be reconfigured as a youth bed, the stabilizer bar 124 may be brought out of storage and attached as will be described below.

If a hidden location of stabilizer bar 124 is preferred, the stabilizer bar 124 may be stored in a remote location, if desirable, or may be relocated to an alternative location of the youth bed 140. The stabilizer bar 124 may be removed and reattached to the rear panel 116, as shown in FIG. 5, under a forward portion of the mattress support frame 120 as shown in FIG. 6, or under an intermediate portion of the mattress support 120, as shown in FIG. 7. Regardless of location, the stabilizer bar 124 provides supplemental stability for the crib configuration 110 or the youth bed configuration 140. Moreover, in each of these locations, the stabilizer bar is substantially concealed from the exterior of the crib or bed.

Figure 8:
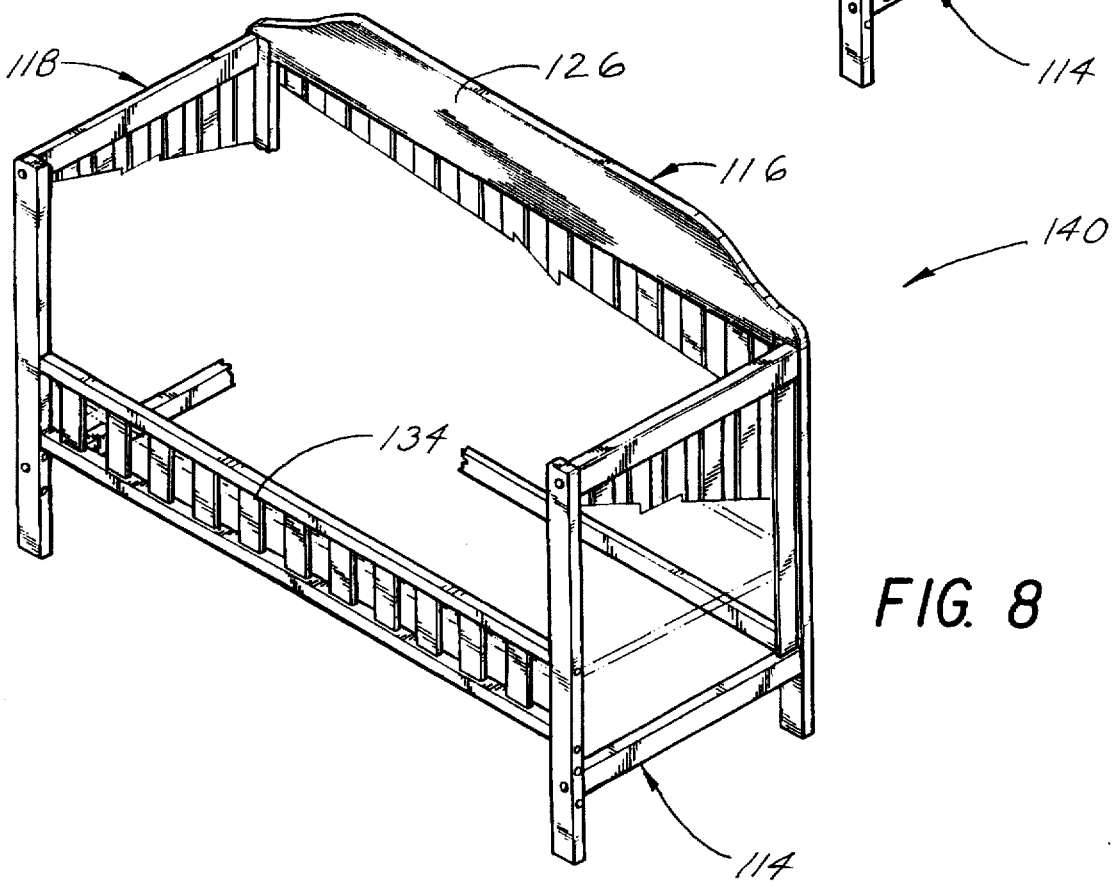
FIG. 8 is a diagrammatic front perspective view of the youth bed configuration showing an upper member of the swing gate attached thereto so as to form a security barrier.
Figure 9:
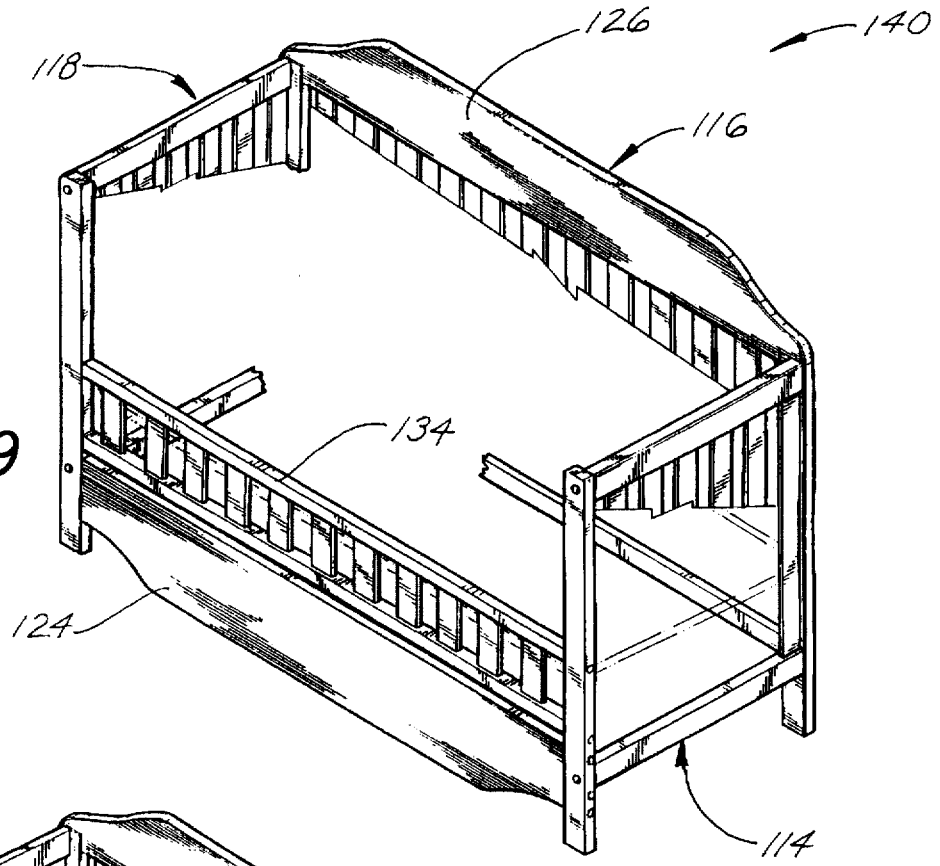
FIG. 9 is a diagrammatic front perspective view of a youth bed showing an upper member of the swing gate attached thereto so as to form a security barrier and the stabilizer bar attached thereto under the upper member of the swing gate.

FIG. 8 shows the upper member 134 of the gate 122 used in place of the stabilizer bar 124 to define a roll bar to prevent a sleeping toddler from accidentally rolling off of the edge of the mattress. If desirable, the stabilizer bar 124 may be reattached in a location beneath the upper member 134 of the gate 122, as is shown in FIG. 9, to provide an alternative facade for the youth bed configuration 140.

Figure 10:
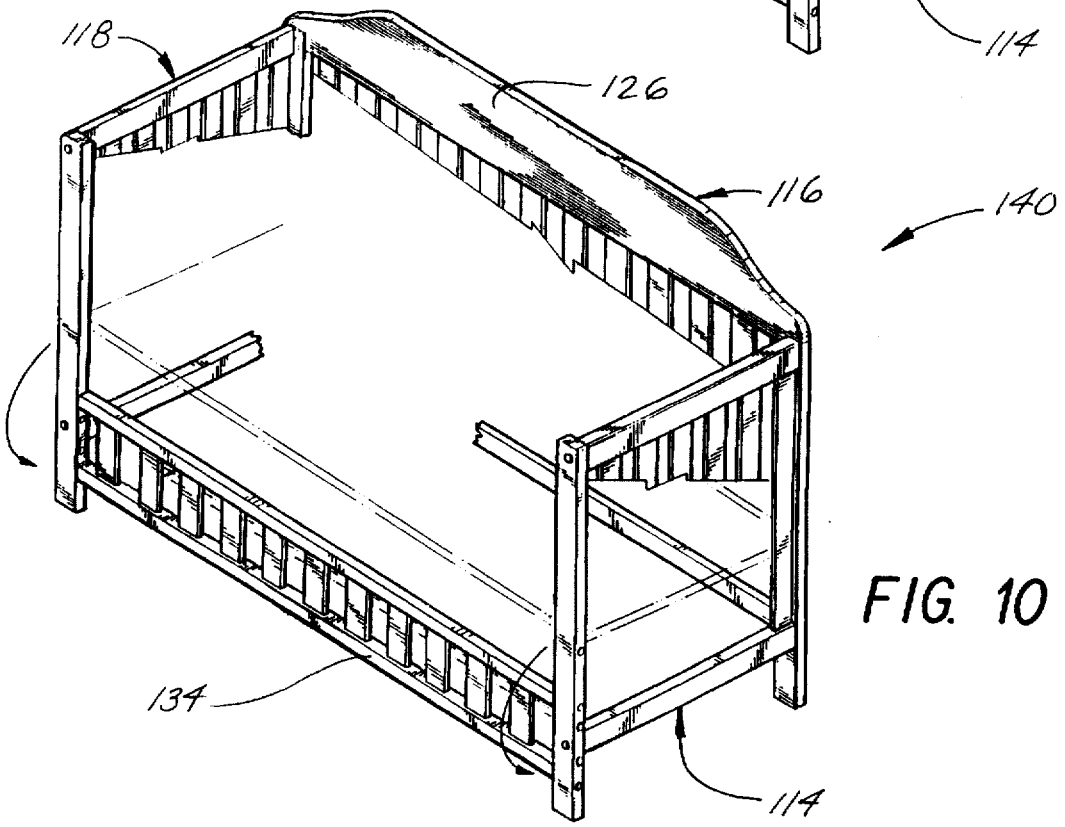
FIG. 10 is a diagrammatic front perspective view of the youth bed configuration shown wherein the upper member of the swing gate is rotated 180 degrees and reattached so as to form a youth bed side rail and provide stability.

As shown in FIG. 10, the top of the upper member 134 of the gate is detached by removing threaded studs or other fasteners which hold the top of the upper member 134 intact. With the fasteners removed, the upper member 134 may be pivoted on its bottom to an inverted position. In this inverted position, the upper member 134 is then reattached with the aformentioned fasteners; thus the roll bar function is eliminated.

Figure 11:
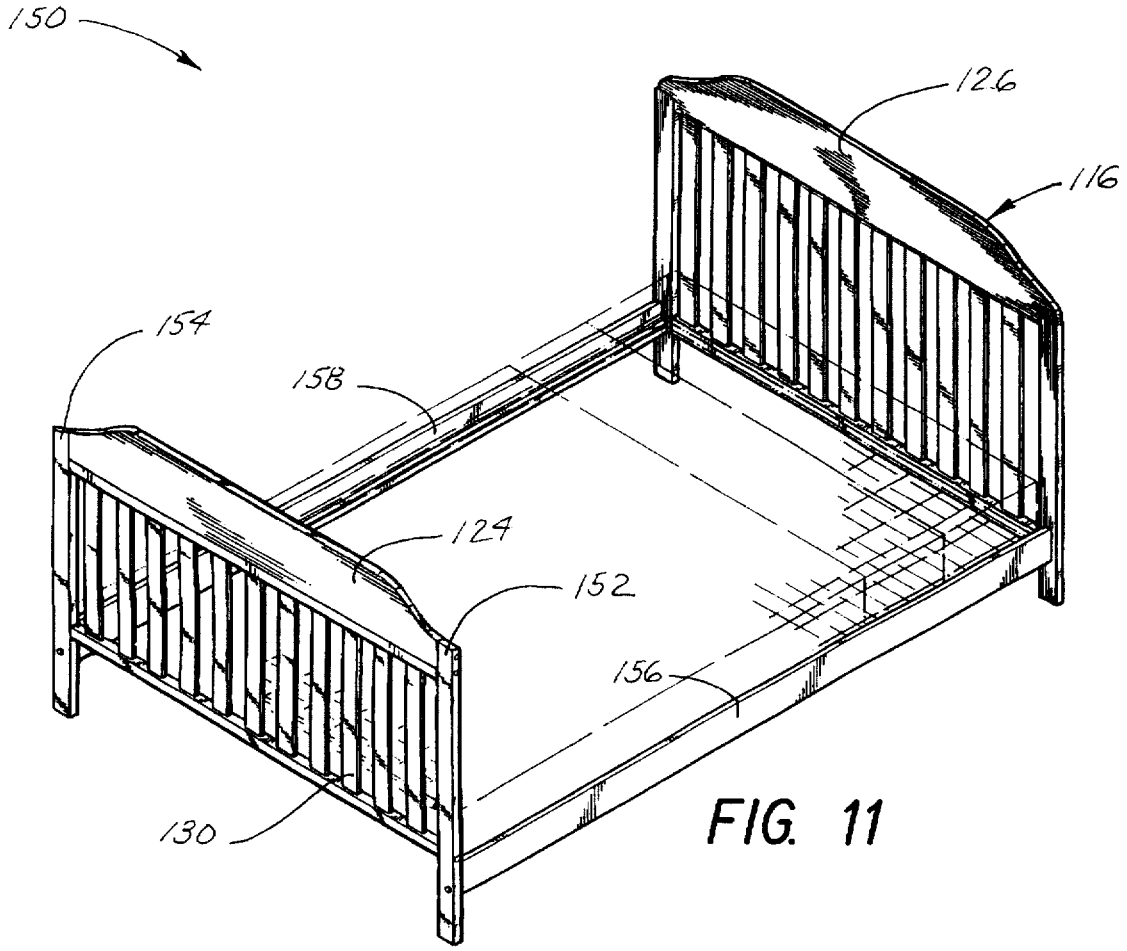
FIG. 11 is a diagrammatic front perspective view of an adult bed configuration having a footboard formed either from the front panel of the crib configuration inverted and with the upper member of the swing gate removed or, alternatively, the view also shows the front, movable drop gate portion of a movable drop gate crib employed as a footboard.

FIG. 11 shows an adult bed 150. Unlike the aforementioned conversions, the adult bed 150 requires the addition and elimination of parts. The rear panel 116 is intended to be common to all embodiments as is the front panel 112, or some portion thereof. These elements 116,112 respectively define the headboard and the footboard of the adult bed 150. However, the left and right side panels 114, 118 as well as the mattress support frame 120 are substituted with independent left and right upright members 152, 154 and left and right bed rails 156, 158. The left and right upright members 152,154 are respectively attached to the left and right edges of the front panel 112, or the portion thereof. Preferably, this is accomplished through the use of threaded studs or other suitable fasteners, through the members 152,154, and into the ends of the rails 156, 158, respectively. Similarly, the rear panel 116 is attached to the other ends of the bed rails 156, 158. Alternatively, the bed rails 156, 158 could be of a conventional type, which includes a flat vertically disposed, downwardly directed hook that is engageable with a slot centrally located and vertically disposed in each of the four upright members, that is the left and right upright members of the rear panel 116 as well as independent upright members 152, 154. The bed rails 156, 158 could also be attachable to the rear panel 116 and the independent upright members 152, 154 in any other suitable manner known to those skilled in the art.

Figure 12:
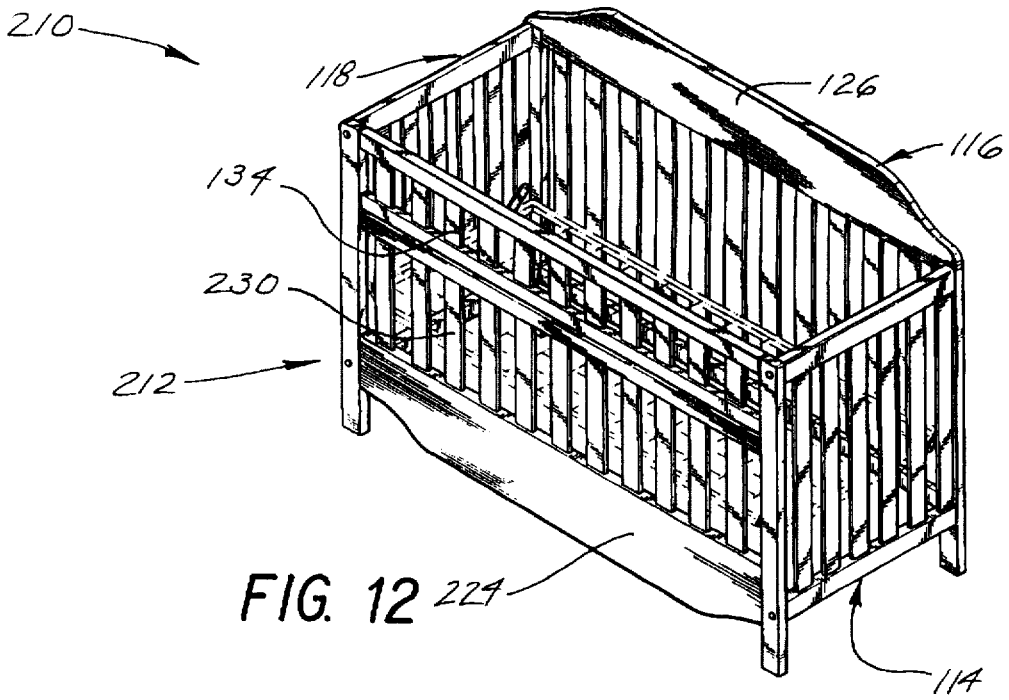
FIG. 12 is a diagrammatic front perspective view of an alternative crib configuration wherein a stabilizer bar is integral with a lower member of the swing gate.

The bed rails 156, 158 join the rear side panel 116 to the selected footboard to provide an adult bed 150 having a strong, solid construction. In this particular configuration, the footboard is formed by inverting a front panel 112 constituting the lower member 130 of the gate 122 and the stabilizer bar 124. Alternatively, of course, the front panel 112 need not be inverted to form a footboard. Furthermore, the footboard could be the drop gate 322 from the drop gate crib construction illustrated in FIGS. 13–16. An alternative front panel 212 is shown in FIG. 12, wherein the stabilizer bar 224 is integral with the lower member 230 of the gate 222. That is, the stabilizer bar 224 and the lower member 230 of the gate 222 are inseparable.

Figure 13:
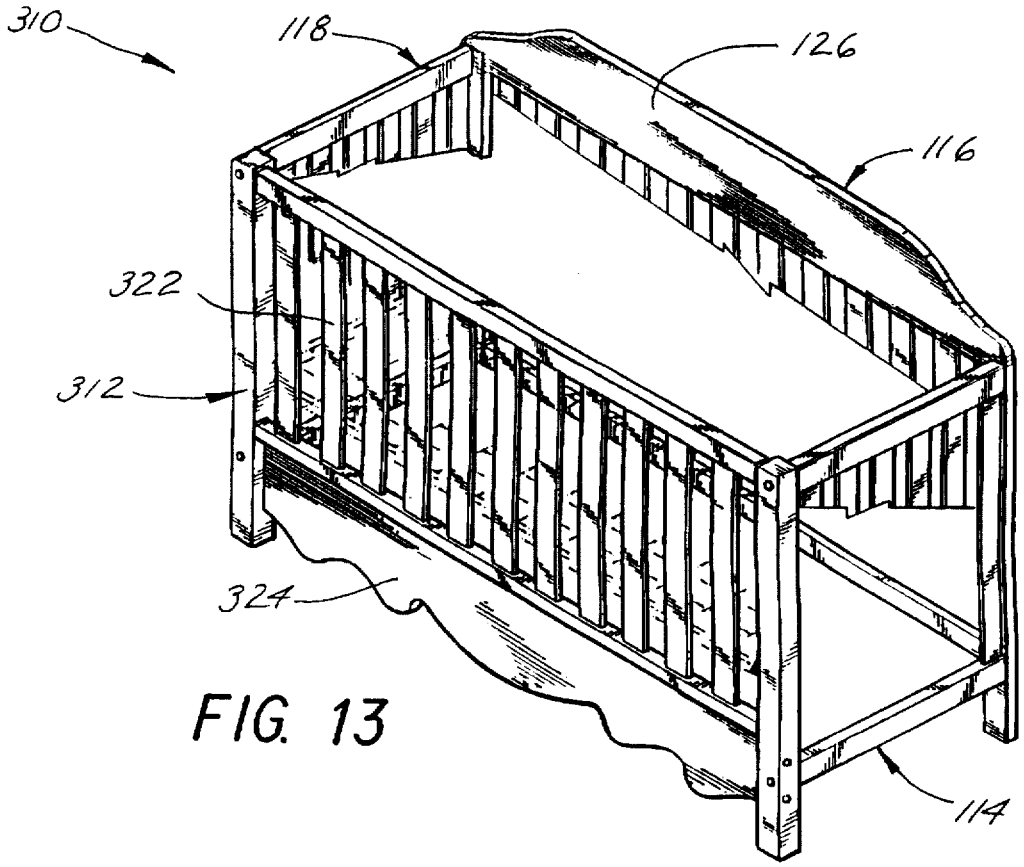
FIG. 13 is a diagrammatic front perspective view of yet another alternative crib configuration showing a front panel formed from a drop gate and a somewhat decoratively modified stabilizer bar.
Figure 14:
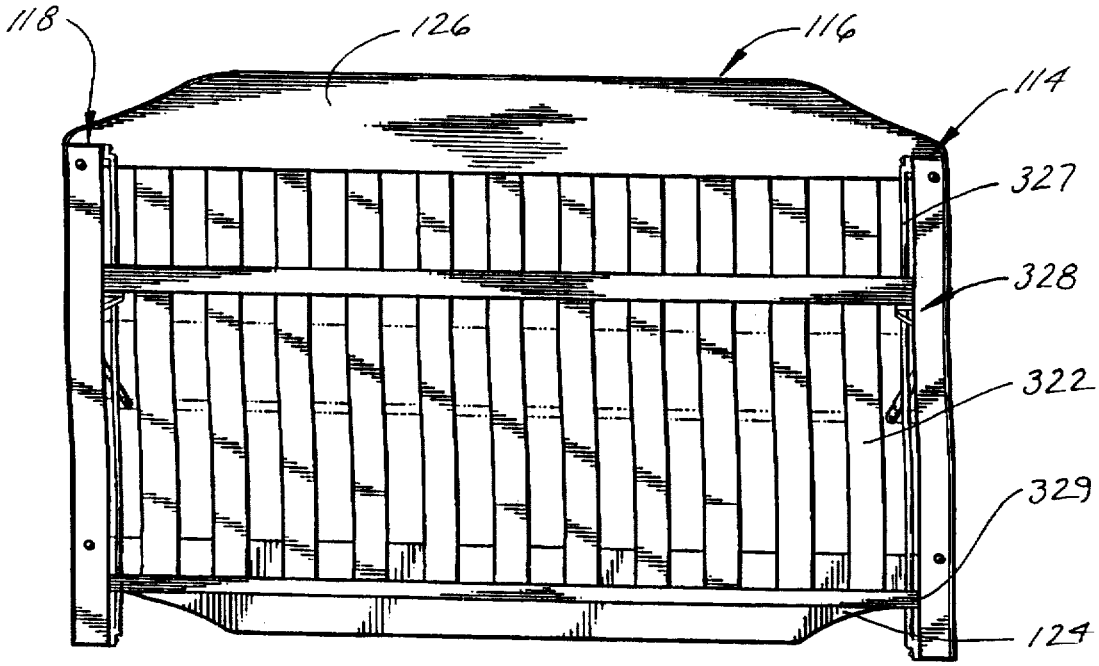
FIG. 14 is an enlarged scale, front elevational view of the front panel shown in FIG. 13 wherein the drop gate is arranged to be lowered forwardly of the stabilizer bar, the stabilizer bar shown being the same as that of the other views.
Figure 15:
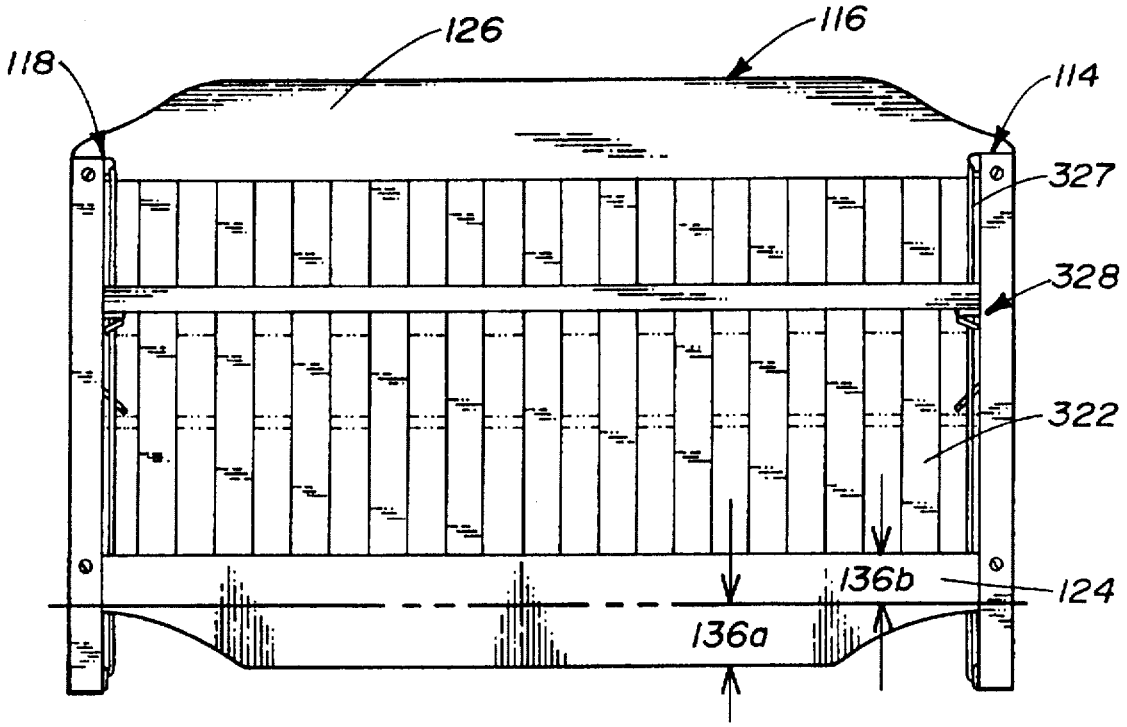
FIG. 15 is a detail view of the front panel shown in FIG. 14 wherein the drop gate is arranged to be lowered rearwardly of the stabilizer bar.

Now referring to FIG. 13, an alternative crib configuration 310 is shown, wherein the front panel 312 is formed from a drop gate 322 and a stabilizer bar 324. The drop gate 322 and the stabilizer bar 324 may be offset relative to one another, or the gate 322 may be positioned directly over the bar 324, depending on the movable drop gate mechanism chosen. These drop gate mechanisms are old and well known, and form no part of the instant invention per se. Depending on the arrangement of the drop gate 322 and the stabilizer bar 324, the drop gate 322 is displaceable to drop down in front of the stabilizer bar 324, as shown in FIG. 14, or behind the stabilizer bar 324, as shown in FIG. 15. The drop gate 322 is displaceable along rails 327. The rails 327 are attached to left and right upright members. Upper spring urged latches and guides 328, and lower guides 329 are attached to the upper and lower ends of the right and left sides of the drop gate 322, and are slidably engageable with the rails 327. The spring urged latches and guides 328 normally engage the rails 327 to preclude movement of the drop gate 322 and are displaceable to permit the drop gate 322 to be displaced upwardly and downwardly within a vertical plane.

Figure 16:
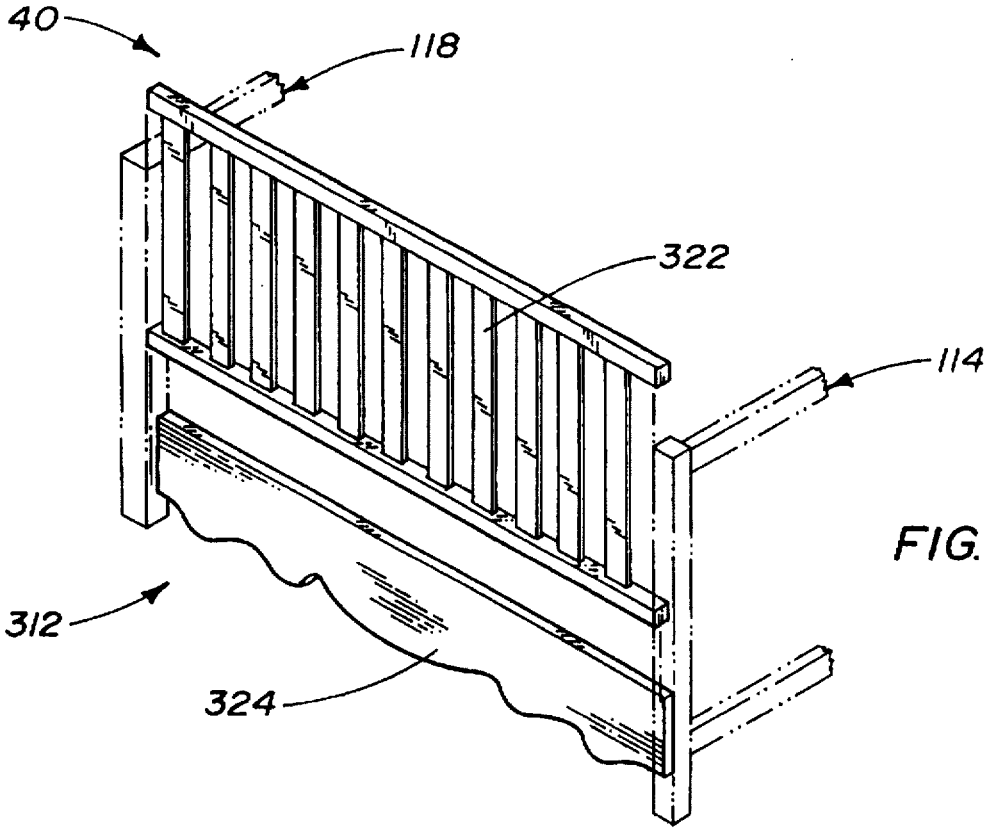
FIG. 16 is a partially exploded, diagrammatic front perspective view of the crib configuration shown in FIG. 13.

In FIG. 16, the front panel 312 is removable to produce a youth bed 340. It can easily be seen that the front panel 312 is formed by the drop gate 322 and the stabilizer bar 324. It should be noted that the stabilizer bar 324 and the drop gate 322 may be combined and/or inverted so as to form a foot board for an adult bed.

Figure 17:
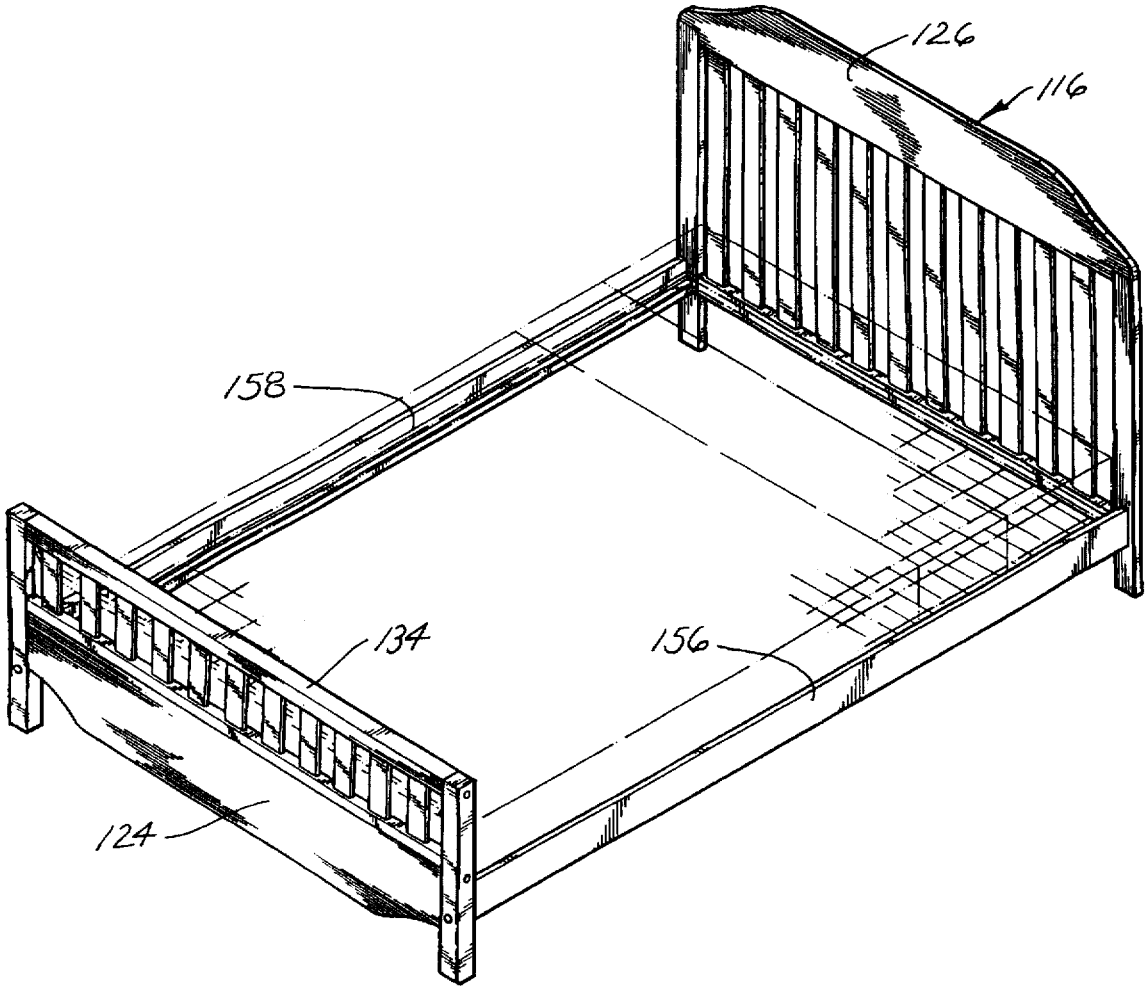
FIG. 17 is a perspective view similar to FIG. 11, but showing a swing gate and stabilizer bar together as a footboard in the adult bed configuration.

Yet another one of a number of possible variations on the theme of a footboard is illustrated in FIG. 17. Here, a swing gate 134 is combined with a stabilizer bar 124 to form a footboard, together with a pair of upright vertical members which are attached to bed rails 156, 158, as described hereinbefore.

Unused components of this article of furniture are easily stored and each component is designed to occupy a nominal amount of storage space. An article of furniture of this type may be fabricated such that it is a coordinated part of a group of articles. Hence, a single bedroom set could conceivably be used throughout the entire life of an individual.

It is to be understood that the present invention is not limited to the embodiments described above, but encompasses any and all embodiments within the scope of the following claims.

We claim:

1. A convertible article of furniture, comprising:

a plurality of separable panels including at least a first separable panel having a first removably attachable section, said first removably attachable section being detachable, relocatable, and subsequently reattachable in a plurality of alternative locations relative to at least one other of said plurality of panels so as to selectively form a crib configuration, a youth bed configuration, and an adult bed configuration;

a second removably attachable section including a stabilizer bar, said stabilizer bar being detachable, relocatable, and subsequently reattachable in a plurality of alternative locations relative to at least one other of said plurality of panels so as to selectively form a crib configuration, a youth bed configuration, and an adult bed configuration;

said stabilizer bar having at least one vertically projecting longitudinally extending portion wherein said vertical projection extends outwardly a distance at least substantially equal to the width of the non-vertically projecting portion of said stabilizer bar; and means for supporting a mattress, said support means being suspended by at least two of said plurality of panels.

2. The convertible article of furniture according to claim 1, wherein said first removably attachable section includes a swing gate.

3. The convertible article of furniture according to claim 1, wherein said first removably attachable section includes a drop gate.

4. The convertible article of furniture according to claim 1 wherein said longitudinally extending vertically projecting portion of said stabilizer bar is centrally located along one side of said stabilizer bar.

5. The convertible article of furniture according to claim 4 wherein said vertically projecting longitudinally extending portion of said stabilizer bar is spaced inwardly from the ends of said stabilizer bar to facilitate entrance into and exit from said convertible article of furniture when configured as a youth bed, while said vertically projecting portion inhibits a user from rolling off a bed when so configured.

6. The convertible article of furniture according to claim 1 wherein said longitudinally extending vertically projecting portion of said stabilizer bar is formed by a sloping curve beginning adjacent to the ends of said stabilizer bar and increasing in the slope of curvature as the curve approaches the maximum vertical projection thereof.

7. A convertible article of furniture, comprising:

a plurality of separable panels including at least a first separable panel, said first separable panel including at least a first removably attachable section and a second removably attachable section, said first movable attachable section further being detachable and subsequently selectively reattachable in a plurality of alternative locations relative to at least one other of said plurality of panels so as to selectively form alternative configurations, said alternative configurations including at least a crib configuration, a youth bed configuration, and an adult bed configuration, said first removably attachable section being displaceable between a first position and a second position, a second removably attachable section including a stabilizer bar detachable, relocatable, and subsequently reattachable in a plurality of alternative locations relative to at least one other of said plurality of panels so as to selectively form a crib configuration, a youth bed configuration, and an adult bed configuration, said stabilizer bar having a vertically projecting longitudinally extending portion wherein said vertical projection extends outwardly a distance at least substantially equal to the width of the non-vertically projecting portion of said stabilizer bar, and means for supporting a mattress, said support means being suspended by at least two of said plurality of panels.

8. The convertible article of furniture according to claim 7, wherein said first removably attachable section includes a gate, and said plurality of separable panels further includes:

a left and right side panel, and a rear panel.

9. The convertible article of furniture according to claim 8, wherein said left and right panels and a front panel and a rear panel are releasably joined together so as to form a substantially rectangular structure, said substantially rectangular structure defining said crib configuration having an interior, and said gate being displaced to provide access to said interior of said crib configuration.

10. The convertible article of furniture according to claim 9, wherein said stabilizer bar and said gate are configured to be selectively arranged to produce said youth bed.

11. The convertible article of furniture according to claim 10, wherein said stabilizer bar is further configured with said youth bed wherein said longitudinally extending vertically projecting portion extends above a mattress when supported on said support means to form a roll bar.

12. The convertible article of furniture according to claim 10, wherein said gate is further configured with said youth bed to form a roll bar.

13. The convertible article of furniture according to claim 12, wherein said stabilizer bar is further configured to cooperate with said youth bed in a position parallel to and beneath said means for supporting a mattress to be substantially concealed from view while continuing to provide stability for said youth bed.

14. The convertible article of furniture according to claim 8, wherein said stabilizer bar and said gate are supported in a position parallel to and adjacent one another to be selectively arranged to produce said youth bed.

15. The convertible article of furniture according to claim 14, wherein said stabilizer bar is further configured with said youth bed to form a roll bar.

16. The convertible article of furniture according to claim 14, wherein said gate is positioned adjacent to and coplanar with said stabilizer bar with said youth bed to form a roll bar.

17. The convertible article of furniture according to claim 16, wherein said stabilizer bar is further configured with said crib bed configuration and said youth bed configuration to be substantially concealed from view while continuing to provide stability for said article of furniture being supported parallel to and beneath said means for supporting mattress.

18. The convertible article of furniture according to claim 7, wherein said first removably attachable section includes a gate, said second removably attachable section includes a stabilizer bar, said plurality of separable panels further include:

a rear panel, and said support means includes a left rail and a right rail.

19. The convertible article of furniture according to claim 18, wherein said left and right rails and said front and rear panels are releasably joined together so as to form a substantially rectangular structure, said substantially rectangular structure defining said adult bed configuration.

20. The convertible article of furniture according to claim 7, wherein said first removably attachable section includes a swing gate.

21. The convertible article of furniture according to claim 7, wherein said first removably attachable section includes a drop gate.

22. The convertible article of furniture according to claim 7, wherein said longitudinally extending vertically projecting portion of said stabilizer bar is centrally located along one side of said stabilizer bar.

23. The convertible article of furniture according to claim 22, wherein said vertically projecting longitudinally extending portion of said stabilizer bar is spaced inwardly from the ends of said stabilizer bar to facilitate entrance into and exit from said convertible article of furniture when configured as a youth bed, while said vertically projecting portion inhibits a user from rolling off a bed when so configured.

24. The convertible article of furniture according to claim 7, wherein said longitudinally extending vertically projecting portion of said stabilizer bar is formed by a sloping curve beginning adjacent to the ends of said stabilizer bar and increasing in the slope of curvature as the curve approaches the maximum vertical projection thereof.

25. An article of furniture which may be configured to provide a crib, a youth bed, or an adult bed, said article of furniture comprising:

a substantially planer vertical rear panel;

a substantially planer vertical front panel comprising:

a substantially planer vertical lower stabilizer bar section being essentially planer and having a top edge, a bottom edge, a right edge and a left edge;

said stabilizer bar section bottom edge having a vertically projecting longitudinally extending portion wherein said vertically projecting portion extends outwardly a distance at least substantially equal to the width of the non-vertically projecting portion thereof;

a substantially planer two-part vertical gate section;

said two-part gate section including a substantially vertical first part intermediate gate section being essentially planer and having a top edge, a bottom edge, a right edge and a left edge, said bottom edge of said intermediate gate section being positioned adjacent the top edge of said stabilizer bar section, a substantially vertical upper gate section positioned above said intermediate gate section and being essentially planer and having a top edge, bottom edge, a right edge, a left edge and a hinge to permit said gate section to move in to and out from a locked upright vertical position;

a substantially vertical right side panel being essentially planer and removably attachable to said front panel and to said rear panel from which said right side panel is supported;

a substantially vertical left side panel being essentially planer and removably attachable to said front panel and to said rear panel from which said left side panel is supported;

a mattress support frame;

said rear panel, said front panel lower stabilizer bar section, said front panel intermediate gate section, said front panel upper gate section, and said right side panel and said left side panel each being removably attachable for assembly into a crib, a youth bed or an adult bed configuration;

said front panel lower stabilizer bar section being removably positionable from a vertical plane with its top edge up into a vertical plane with its top edge down for assembly into the roll bar of a youth bed;

said upper gate section of said front panel being removably positionable from the uppermost portion of said front panel to a lower position adjacent said mattress support frame for assembly into the roll bar of a youth bed;

said lower stabilizer bar section of said front panel adapted for being removably positionable from the lowermost position of said front panel to a horizontal position beneath and parallel to said mattress support frame;

said lower stabilizer bar section of said front panel adapted for being removably positionable from the lowermost position of said front panel to a horizontal position beneath and perpendicular to said mattress support frame;

said lower stabilizer bar section of said front panel adapted for being removably positionable from the lowermost position of said front panel to said rear panel at a position beneath said mattress support frame and coplanar with said rear panel;

a right side and a left side bed rail, each of said rails having opposing ends removably attachable to said vertical rear panel and one of said sections of said vertical front panel;

a pair of independent legs each removably attachable to said right side or left side bed rails, and removably attachable to said lower stabilizer bar section or said upper gate section of said front panel, for assembly into a footboard of an adult bed configuration;

said lower stabilizer bar section of said front panel adapted for being removably positionable from the lowermost portion of said front panel for engagement with said independent legs for assembly into the footboard of an adult bed configuration; and said upper gate section of said front panel adapted for being removably positionable from the uppermost portion of said front panel for engagement with said independent legs for assembly into the footboard of an adult bed configuration.

26. An article of furniture which may be configured to provide a crib, a youth bed, or an adult bed, said article of furniture comprising:

a substantially planer vertical rear panel;

a substantially planer vertical front stabilizer panel having a vertically projecting longitudinally extending bottom edge portion wherein said vertically projecting portion extends outwardly a distance at least substantially equal to the width of the non-vertically projecting portion thereof;

a substantially vertical gate section movable in a vertical plane adjacent to said stabilizer to facilitate entrance to and exit from said furniture when in a crib configuration;

a substantially vertical right side panel being essentially planer and removably attachable to said front stabilizer panel and to said rear panel from which said right side panel is supported;

a substantially vertical left side panel being essentially planer and removably attachable to said front stabilizer panel and to said rear panel from which said left side panel is supported;

a mattress support frame;

said rear panel, said front stabilizer panel, said gate section, and said right side panel and said left side panel each being removably attachable for assembly into a crib, a youth bed or an adult bed configuration;

said front stabilizer panel being removably positionable from a vertical plane with said vertically projecting portion extending down into a vertical plane with said vertically projecting portion extending up for assembly into the roll bar of a youth bed;

said front stabilizer panel adapted for being removably positionable to a horizontal position beneath and parallel to said mattress support frame;

said front stabilizer panel adapted for being removably positionable to a horizontal position beneath and perpendicular to said mattress support frame;

said front stabilizer panel adapted for being removably positionable to a position beneath and coplanar with said rear panel;

a right side and a left side bed rail, each of said rails having opposing ends removably attachable to said vertical rear panel and said front panel;

a pair of independent legs each removably attachable to said right side or left side bed rails, and removably attachable to said front stabilizer panel, for assembly into a footboard of an adult bed configuration; and said front stabilizer panel being removably positionable for engagement with said independent legs, for assembly into the footboard of an adult bed configuration.

27. The article of furniture according to claim 26 wherein said gate section is removably positionable for engagement with said independent legs for assembly into the footboard of an adult bed configuration.

* * * * *